US009682837B2

(12) United States Patent
Yang

(10) Patent No.: US 9,682,837 B2
(45) Date of Patent: Jun. 20, 2017

(54) WINDING ASSEMBLY

(71) Applicant: ScienBiziP Consulting (Shenzhen) Co., Ltd., Shenzhen (CN)

(72) Inventor: Guang Yang, Shenzhen (CN)

(73) Assignee: ScienBiziP Consulting(Shenzhen)Co., Ltd., Shenzhen (CN)

( * ) Notice: Subject to any disclaimer, the term of this patent is extended or adjusted under 35 U.S.C. 154(b) by 398 days.

(21) Appl. No.: 14/306,892

(22) Filed: Jun. 17, 2014

(65) Prior Publication Data

US 2014/0374530 A1 Dec. 25, 2014

(30) Foreign Application Priority Data

Jun. 20, 2013 (CN) ..... 2013 1 0246097

(51) Int. Cl.
*B65H 18/08* (2006.01)
*B65H 19/26* (2006.01)
*B65H 18/10* (2006.01)

(52) U.S. Cl.
CPC ..... *B65H 18/085* (2013.01); *B65H 18/103* (2013.01); *B65H 2301/5151* (2013.01); *B65H 2301/51532* (2013.01); *B65H 2403/20* (2013.01); *B65H 2701/11332* (2013.01)

(58) Field of Classification Search
CPC ..... B65H 18/085; B65H 18/103; B65H 2701/11332; B65H 2403/20; B65H 2301/5151
See application file for complete search history.

(56) References Cited

U.S. PATENT DOCUMENTS 2,576,710 A * 11/1951 Andrews ..... B65H 18/103 156/759
2,986,350 A * 5/1961 Bugg ..... H01F 41/08 242/434.5
3,106,324 A * 10/1963 Fritzinger ..... B65C 11/00 225/26
3,383,063 A * 5/1968 Balaban ..... A47L 25/005 15/104.002
4,381,600 A * 5/1983 Mas ..... C22C 19/00 242/434.7
4,921,567 A * 5/1990 Criswell, Jr. ..... B65H 54/28 156/361
2006/0175017 A1* 8/2006 Namekawa ..... B65H 35/0026 156/443

* cited by examiner

*Primary Examiner* — William A Rivera
(74) *Attorney, Agent, or Firm* — Steven Reiss

(57) ABSTRACT

A winding assembly includes a first supporting member, a pivot shaft, a driving assembly, and a limiting member. The pivot shaft is partly received in the first supporting member. The pivot shaft is configured to support the adhesive tape coil thereon. The adhesive tape coil is configured to be rotatable relative to the first supporting member. The driving assembly includes a secondary shaft. The secondary shaft is partly received in the first supporting member and capable of moving relative to the first supporting member. A first end of the secondary shaft is exterior to the first supporting member and is configured to couple to the hollow rod. The limiting member is spaced a preset distance from the first supporting member and capable of moving relative to the first supporting member. The limiting member and the first supporting member are configured to cooperatively limit the wound adhesive tape.

12 Claims, 5 Drawing Sheets

WINDING ASSEMBLY

FIELD

The present disclosure relates to mechanical techniques and particularly to a winding assembly capable of winding adhesive tape of an adhesive tape coil to a hollow rod.

BACKGROUND

Unqualified devices may need to be rebuilt, however, adhesive may remain on a surface of the unqualified devices. Thus, the adhesive must be cleaned from the surface before the rebuilding begins. Usually, a hollow rod wound with adhesive tape is used to clear the adhesive from the unqualified devices.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
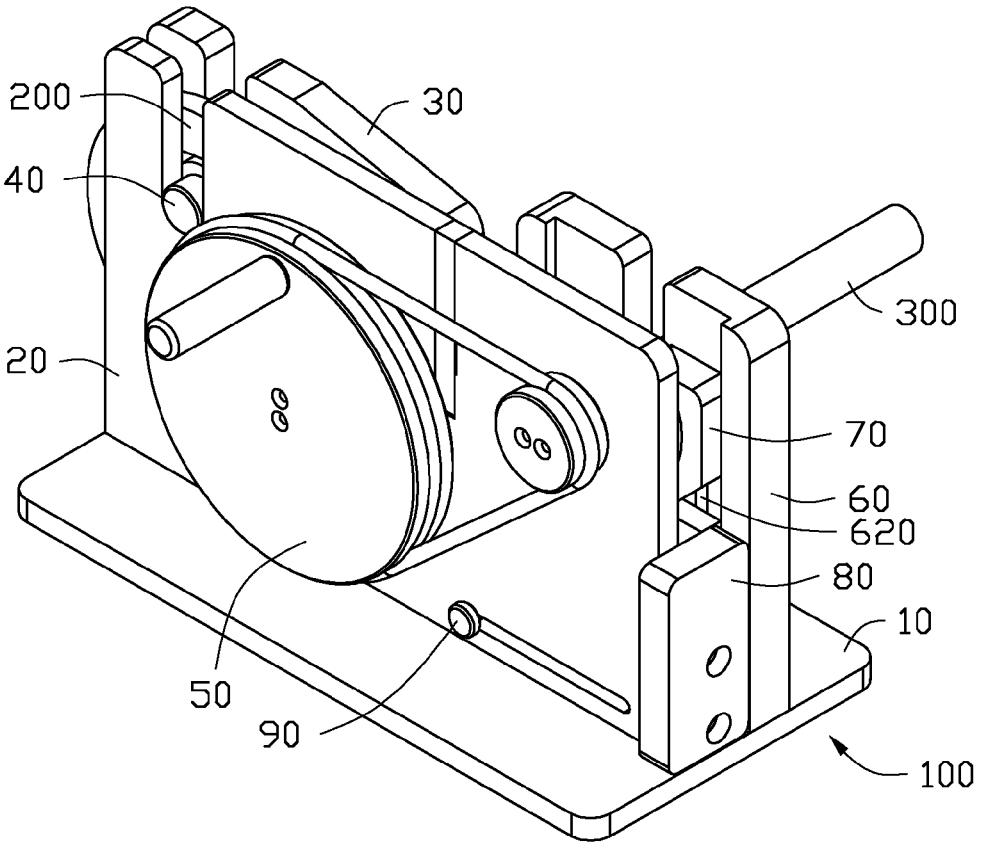
FIG. 1 is an isometric view showing an example winding assembly winding adhesive tape of an adhesive tape coil to a hollow rod.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. In addition, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. Several definitions that apply throughout this disclosure will now be presented. It should be noted that references to "an" or "one" embodiment in this disclosure are not necessarily to the same embodiment, and such references mean "at least one." The references "a plurality of" and "a number of" mean "at least two." Embodiments of the present disclosure will be described with reference to the accompanying drawings.

Figure 2:
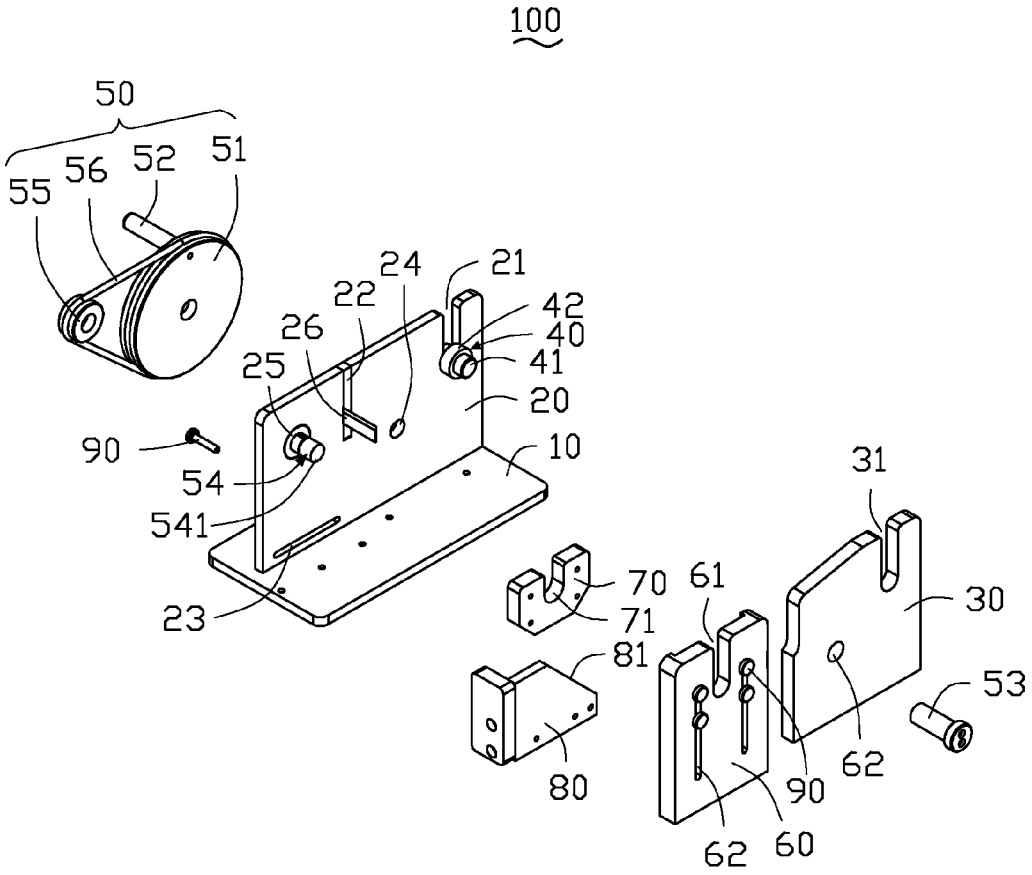
FIG. 2 is an exploded, isometric view showing the example winding assembly of FIG. 1.
Figure 3:
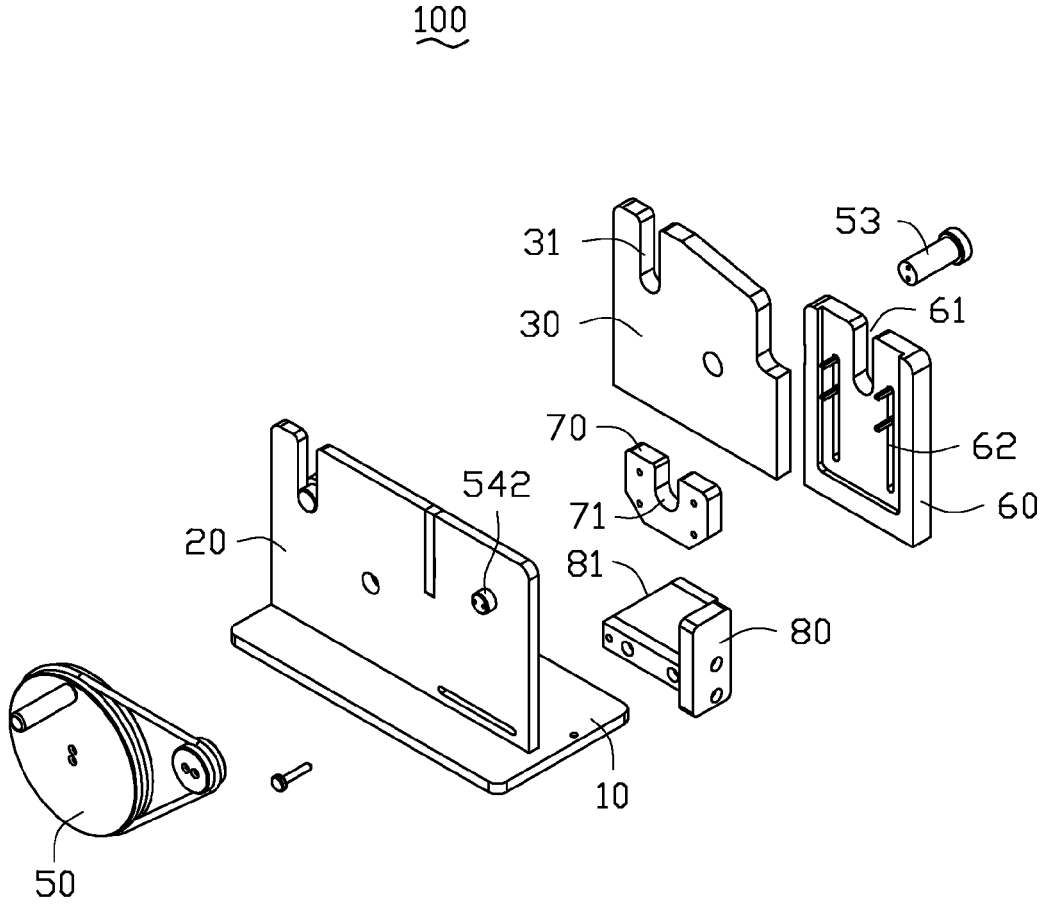
FIG. 3 is an exploded, isometric view showing the example winding assembly of FIG. 1 from another angle.

FIGS. 1-3 illustrate a winding assembly 100 in accordance with an exemplary embodiment. The winding assembly 100 can wind adhesive tape of an adhesive tape coil 200 to a hollow rod 300. One inward facing side of the adhesive tape of the adhesive tape coil 200 is coated with an adhesive. The winding assembly 100 can include a base 10, a first supporting member 20, a second supporting member 30, a pivot shaft 40, a driving assembly 50, a positioning member 60, a limiting member 70, a sliding member 80, and a number of latching members 90.

The first supporting member 20 is perpendicularly fixed to the base 10. The first supporting member 20 defines a first opening groove 21, a receiving slot 22, at least one guiding slot 23, a first through hole 24, and a second through hole 25. The first opening groove 21 is defined by notching the first supporting member 20 a first distance downward to receive a partial of the pivot shaft 40. The receiving slot 22 is arranged between the first opening groove 21 and the second through hole 25. The receiving slot 22 extends along the length of the first supporting member 20. The first supporting member 20 further includes a blade 26. The blade 26 is received in the receiving slot 22, and is capable of moving upward and downward along the receiving slot 22 to cut the adhesive tape. The at least one guiding slot 23 extends along the length of the first supporting member 20. In the embodiment, one guiding slot 23 is employed. The first through hole 24 can receive a part of the driving assembly 50, and the second through hole 25 can receive another part of the driving assembly 50.

The second supporting member 30 is fixed to the base 10 and parallel with the first supporting member 20. The second supporting member 30 defines a second opening groove 31 and a third through hole 32 respectively opposite to the first opening groove 21 and the first through hole 24. The second opening groove 31 is formed by notching the second supporting member 30 a second distance downward. The second opening groove 31 can receive another part of the pivot shaft 40. The third through hole 32 can receive the part of the driving assembly 50.

The pivot shaft 40 can include a shaft 41 and a ring 42. A first end of the shaft 41 is received in the first opening groove 21 through an opening of the first opening groove 21. A second end of the shaft 41 is received in the second opening groove 31 through an opening of the second opening groove 31. The ring 42 protrudes from the peripheral surface of the shaft 41 near the middle of the shaft 41. In a first embodiment, the opposite sides of the ring 42 respectively resist the first supporting member 20 and the second supporting member 30, limiting the pivot shaft 40 between the first supporting member 20 and the second supporting member 30. The adhesive tape coil 200 is pivoted on the ring 42. In the embodiment, the outer diameter of the ring 42 is slightly less than the inner diameter of the adhesive tape coil 200. When an external force pulls an end of the adhesive tape, the adhesive tape coil 200 rotates around the shaft 41. In an alternative embodiment, the outer diameter of the ring 42 is the same as the inner diameter of the adhesive tape coil 200. When the external force pulls the end of the adhesive tape, the adhesive tape coil 200 and the pivot shaft 40 rotate relative to the first supporting member 20 and the second supporting member 30.

The driving assembly 50 can include a drive wheel 51, a handle 52, a drive shaft 53, a secondary shaft 54, a secondary wheel 55, and a drive belt 56. The handle 52 is attached to the drive wheel 51 and can be manually operated. The drive shaft 53 passes through both the third through hole 32 and the first through hole 24 and is fixed in the center of the drive wheel 51. Thus, the drive wheel 51 can be driven to rotate with the handle 52 when an external force is exerted on the handle 52. The secondary shaft 54 passes through the second through hole 25. A first end 541 of the secondary shaft 54 and a second end 542 of the secondary shaft 54 are respectively exterior to the opposite sides of the first supporting member 20. The first end 541 of the secondary shaft 54 is fixed in a hollow of the hollow rod 300. In the embodiment, the first end 541 of the secondary shaft 54 is threaded to the hollow rod 300. The second end 542 of the secondary shaft 54 is fixed in the center of the secondary wheel 55. The secondary wheel 55 and the drive wheel 51 are on the same side of the first supporting member 20. In the embodiment, a size of the secondary wheel 55 is less than the size of the drive wheel 51. The drive belt 56 is looped over the drive wheel 51 and the secondary wheel 55. Thus, when the handle 52 rotates, the drive wheel 51 can rotate with the handle 52, and the secondary wheel 55, the secondary shaft 54, and the hollow rod 300 can rotate with the drive wheel 51 via the drive belt 56.

The positioning member 60 is fixed to the base 10, parallel with the first supporting member 20, and is flush with the second supporting member 30. The positioning member 60 and the first supporting member 20 cooperatively form a space 620 (see FIG. 1) to receive the limiting member 70 and the sliding member 80. The positioning member 60 defines a positioning hole 61 and at least one sliding slot 62. The positioning hole 61 is opposite to the second through hole 25, thus the hollow rod 300 can pass through the positioning hole 61 and can be fixed to the first end 541 of the secondary shaft 54. In the embodiment, two sliding slots 62 are employed. The sliding slots 62 are parallel with each other. Each sliding slot 62 extends along the height of the positioning member 60.

The limiting member 70 is slidably arranged between the first supporting member 20 and the positioning member 60, and spaced a preset distance from the first supporting member 20. The limiting member 70 defines a positioning groove 71 by notching the limiting member 70 a third distance downward. The end of the positioning groove 71 is opposite to the positioning hole 61. At least one latching member 90 passes through at least one sliding slot 62 and is fixed in the limiting member 70. In the embodiment, two latching members 90 are employed. Thus, the limiting member 70 is slidably connected to the positioning member 60 and is capable of sliding upward and downward along the sliding slots 62. In the embodiment, each latching member 90 can be a screw.

The sliding member 80 is also slidably arranged between the first supporting member 20 and the positioning member 60. The sliding member 80 can include an incline surface 81. The incline surface 81 extends along the moving direction of the sliding member 80. The limiting member 70 is above the sliding member 80 and contacts the inclined surface 81. At least one latching member 90 passes through the guiding slot 23 and is fixed in the sliding member 80. Thus, the sliding member 80 is capable of sliding along the guiding slot 23 into or out off the space 620. In the embodiment, the sliding member 80 is capable of sliding forward and backward along the sliding slots 62.

Figure 4:
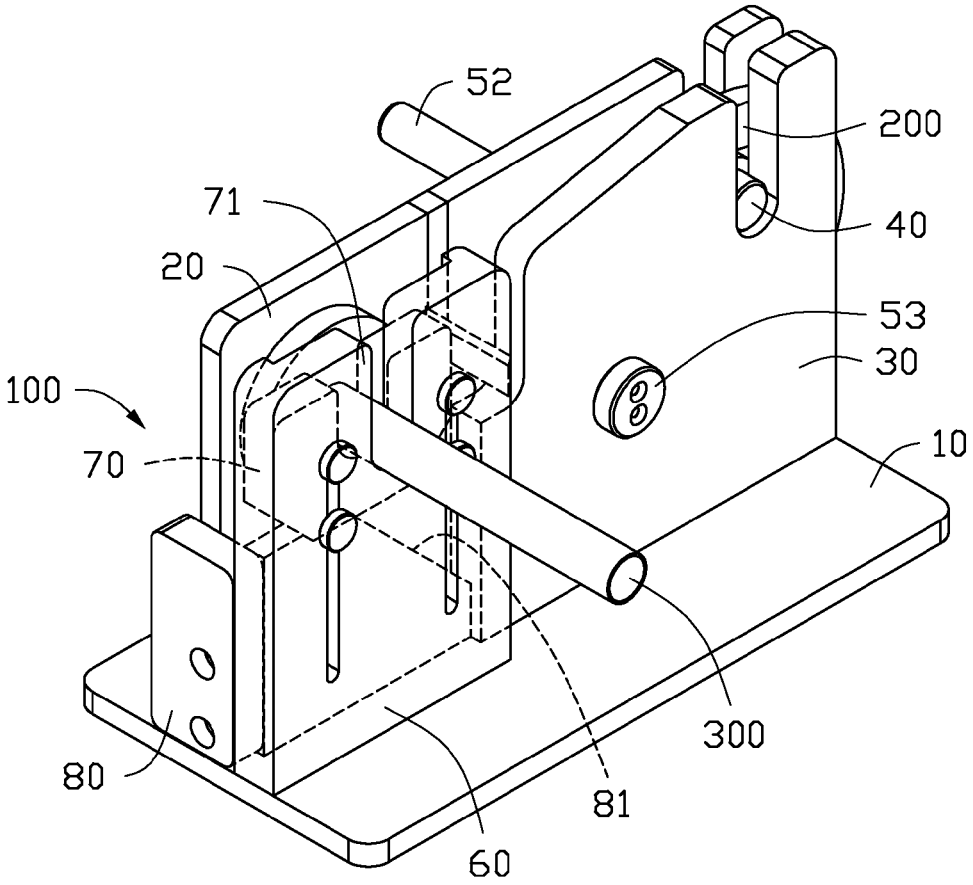
FIG. 4 is a perspective view of the example winding assembly of FIG. 1, showing a first state of the limiting member and the sliding member.

When winding the hollow rod 300 with the adhesive tape of the adhesive tape coil 200, the sliding member 80 is pushed to move along the guiding slot 23 into the space 620, the sliding member 80 can exert an upward force to the limiting member 70 via the incline surface 81, and the limiting member 70 can move upward until the hollow rod 300 passes through the positioning groove 71. Then, fix the end of the adhesive tape of the adhesive tape coil 200 to the hollow rod 300 and rotate the handle 52, the drive wheel 51 can rotate with the handle 52. The secondary wheel 55, the secondary shaft 54, and the rod 300 can rotate with the drive wheel 51 via the drive belt 56. Thus, the adhesive tape of the adhesive tape coil 200 can be wound to the hollow rod 300 to form an adhesive ring, and the adhesive can be formed on the outer surface of the adhesive ring. Simultaneously, the wound adhesive tape can be sandwiched between the limiting member 70 and the first supporting member 20. Thus, the limiting member 70 and the first supporting member 20 can cooperatively limit the wound adhesive tape, and avoid an incorrect winding (see FIG. 4).

Figure 5:
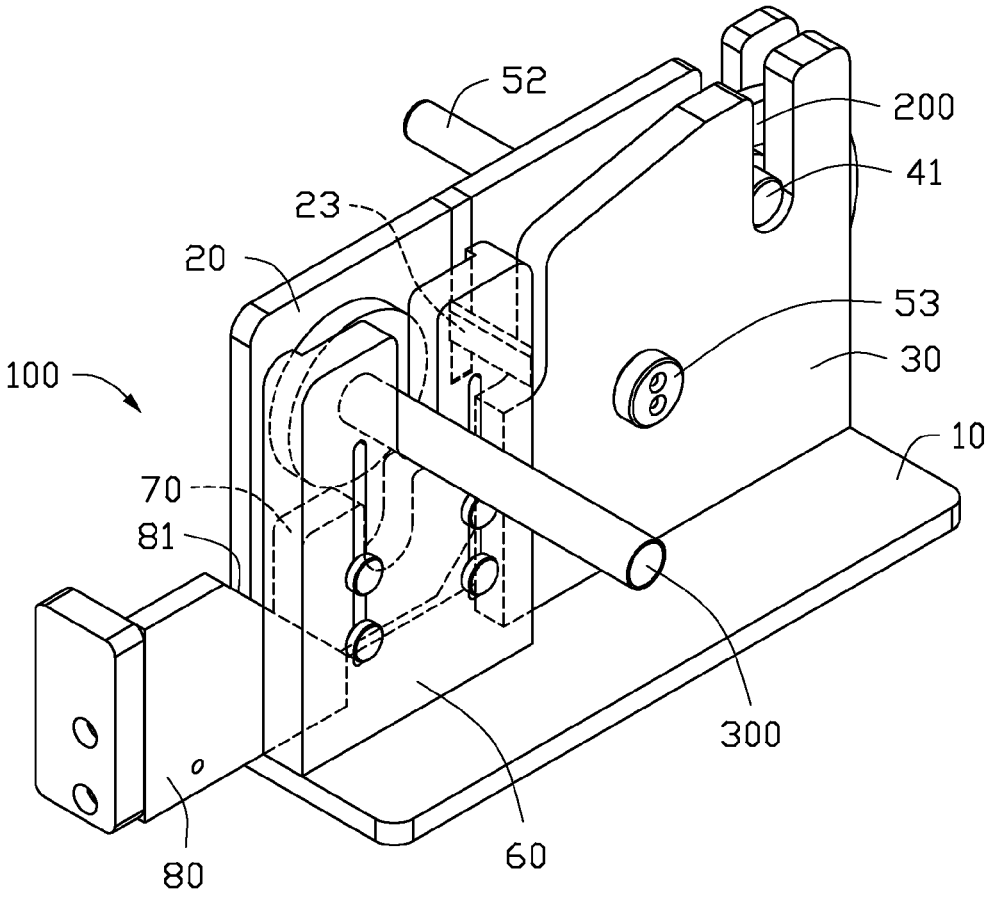
FIG. 5 is a perspective view of the example winding assembly of FIG. 1, showing a second state of the limiting member and the sliding member.

When removing the wound adhesive tape, the blade 26 is moved to cut the adhesive tape. The sliding member 80 is pulled to move along the guiding slot 23 out of the space 620. The incline surface 81 of the sliding member 80 can disengage from the limiting member 70. The limiting member 70 can slide downward along the sliding slots 62 with gravity of the limiting member 70 until the limiting member 70 disengages from the wound adhesive tape. Thus, the hollow rod 300 can be taken away from the first end 541 of the secondary shaft 54 (see FIG. 5).

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A winding assembly winding adhesive tape of an adhesive tape coil (200) to a hollow rod, the winding assembly comprising:

a first supporting member;

a pivot shaft partly received in the first supporting member, the pivot shaft being configured to support the adhesive tape coil thereon, the adhesive tape coil being configured to be rotatable relative to the first supporting member;

a driving assembly comprising a secondary shaft, the secondary shaft being partly received in the first supporting member and capable of moving relative to the first supporting member, a first end of the secondary shaft being exterior to the first supporting member and configured to be coupled to the hollow rod; and a limiting member spaced a preset distance from the first supporting member and capable of moving relative to the first supporting member, the limiting member and the first supporting member being configured to cooperatively limit the wound adhesive tape;

wherein the winding assembly further comprises a base, the first supporting member is substantially perpendicularly fixed to the base;

wherein the winding assembly further comprises a positioning member, the positioning member is fixed to the base, parallel with the first supporting member, and flush with the second supporting member; the positioning member defines a positioning hole configured to allow the hollow rod to pass through and to be fixed therein, the limiting member is slidably connected to the positioning member.

2. The winding assembly as described in claim 1 wherein the winding assembly further comprises at least one latching members; the positioning member defines at least one sliding slot, the at least one sliding slot extends along the height of the positioning member to receive the at least one latching member, and the at least one latching member passes through the at least one sliding slot and is fixed in the limiting member, causing the limiting member to be slidably connected to the positioning member and capable of sliding upward and downward along the at least one sliding slot.

3. The winding assembly as described in claim 1 further comprising a sliding member, wherein the sliding member is slidably arranged between the first supporting member and the positioning member, the sliding member comprises an incline surface, the incline surface extends along the sliding direction of the sliding member; the limiting member is above the sliding member and contacts the incline surface.

4. The winding assembly as described in claim 3, wherein the positioning member and the first supporting member cooperatively form a space to receive the limiting member and the sliding member; the winding assembly further comprises at least one latching members; the first supporting member defines at least one guiding slot, the at least one guiding slot extends along the length of the first supporting member to receive the at least one latching member, and the at least one latching member passes through the at least one guiding slot and is fixed in the sliding member, causing the sliding member to be slidably connected to the first supporting member and capable of sliding along the at least one guiding slot into or out off the space.

5. The winding assembly as described in claim 1, further comprising a second supporting member, wherein the first supporting member defines a first opening groove by notching the first supporting member a predetermined distance downward to receive a first end of the pivot shaft; the second supporting member is fixed to the base and parallel with the first supporting member, the second supporting member defines a second opening groove by notching the second supporting member the predetermined distance downward to receive a second end of the pivot shaft.

6. The winding assembly as described in claim 5 wherein the first supporting member further comprises a blade; the first supporting member further defines a second through hole to receive a partial of the secondary shaft; the first supporting member further defines a receiving slot to receive the blade, the receiving slot is arranged between the first opening groove and the second through hole, and extends along the length of the first supporting member, and the blade is received in the receiving slot and capable of being moved upward and downward along the receiving slot to cut the adhesive tape.

7. The winding assembly as described in claim 5, wherein the pivot shaft comprises a shaft and a ring, the ring protrudes from the peripheral surface of the shaft near the middle of the shaft, and the adhesive tape coil is arranged on the ring.

8. The winding assembly as described in claim 7, wherein the opposite sides of the ring respectively resist the first supporting member and the second supporting member, the pivot shaft is limited between the first supporting member and the second supporting member, the adhesive tape coil is pivotable on the ring.

9. The winding assembly as described in claim 7, wherein the outer diameter of the ring is to be equal to the inner diameter of the adhesive tape coil.

10. The winding assembly as described in claim 1, wherein the first end of the secondary shaft and a second end of the secondary shaft are respectively exterior to the opposite sides of the first supporting member; the driving assembly further comprises a drive wheel, a secondary wheel, and a drive belt, the drive wheel is rotatably connected to the first supporting member, the second end of the secondary shaft is fixed in the center of the secondary wheel, the secondary wheel and the drive wheel are on the same side of the first supporting member, the drive belt is looped over the drive wheel and the secondary wheel.

11. The winding assembly as described in claim 10, wherein the driving assembly comprises a handle, the handle is attached to the drive wheel and manually operated, the drive wheel rotates with the handle when an external force is exerted on the handle.

12. The winding assembly as described in claim 10, wherein the first supporting member defines a first through hole, the driving assembly further comprises a drive shaft, the drive shaft passes through the first through hole and is fixed in the center of the drive wheel, causing the drive wheel to be rotatably connected to the first supporting member.

* * * * *